United States Patent [19]

Kitamura et al.

[11] Patent Number: 4,684,943

[45] Date of Patent: Aug. 4, 1987

[54] UNLOCKING DEVICE FOR A VEHICLE LID

[75] Inventors: Sotoo Kitamura, Aichi; Shigeyuki Akita, Okazaki; Yoshiyuki Kago, Aichi, all of Japan

[73] Assignee: Nippon Soken, Inc., Nishio, Japan

[21] Appl. No.: 821,886

[22] Filed: Jan. 27, 1986

Related U.S. Application Data

[63] Continuation of Ser. No. 489,381, Apr. 28, 1983, abandoned.

[30] Foreign Application Priority Data

Apr. 30, 1982 [JP] Japan ..... 57-71360

[51] Int. Cl.[4] ..... G08C 17/00

[52] U.S. Cl. ..... 340/825.72; 340/825.69

[58] Field of Search ..... 70/256, 257; 340/237, 340/696, 825.31, 825.64, 825.69, 825.72, 543; 324/200, 260; 307/10 R, 10 AT; 361/171, 172; 174/52 PE

[56] References Cited

U.S. PATENT DOCUMENTS

| | | | |
|---|---|---|---|
| 3,168,737 | 2/1965 | Weinstein | 340/825.72 |
| 3,196,440 | 7/1965 | Weinstein | 340/825.72 X |
| 3,233,239 | 2/1966 | Crow et al. | 340/696 |
| 3,488,632 | 1/1970 | Clark III | 340/825.72 X |
| 3,879,709 | 4/1975 | Yukawa | 340/825.72 X |
| 3,937,976 | 2/1976 | McGuirk | 307/10 AT |
| 4,143,368 | 3/1979 | Route et al. | 340/543 |
| 4,362,992 | 12/1982 | Young et al. | 324/260 X |
| 4,405,924 | 9/1983 | Shinoda et al. | 340/825.72 |
| 4,413,261 | 11/1983 | Greenberg | 307/10 AT X |

OTHER PUBLICATIONS

J. J. Hupert, Remote Control by "Near" Magnetic Field, Electronic Industries, Jul. 1959, pp. 82–85.

*Primary Examiner*—Ulysses Weldon

*Attorney, Agent, or Firm*—Cushman, Darby & Cushman

[57] ABSTRACT

A device for unlocking a lid provided in a vehicle includes an unlocking actuator unit, a magnetic sensor unit, a signal processing unit, and a controller means. A transmitter unit with a power source generates and transmits a specific magnetic unlocking signal which is received by the magnetic sensor unit, hence, the unlocking actuator is controlled through the signal processing means and the controller means and, hence, the lid is unlocked.

8 Claims, 17 Drawing Figures

(4)
(9)
(22)
(73)
3
3a
FREQUENCY DIVIDING CCT
COUNTER
MULTI-VIBRATOR
F.F.
VDD

UNLOCKING DEVICE FOR A VEHICLE LID

This is a continuation of application Ser. No. 489,381, filed Apr. 28, 1983, which was abandoned upon the filing hereof.

BACKGROUND OF THE INVENTION

1. Field of the Invention

The present invention relates to a device for unlocking a lid provided in a vehicle. The device according to the present invention is used for automatically opening, for example, a lid of a trunk of an automobile.

2. Description of the Prior Art

In general, the lid of a trunk at the rear portion of an automobile is opened by unlocking the lock attached to the lid of trunk using a key or by closing an operation switch of an electric unlocking device located in a passenger cabin to unlock the device. Customarily, a driver stops his car, locks it, walks somewhere, and often returns to the car with both his hands occupied with luggage. In this case, he must first place his luggage in some suitable place, take out his key, unlock the lock of the car to open the lid of the trunk, and finally put the luggage into the trunk. The driver may feel the above-mentioned series of operations cumbersome and may desire any means which makes it possible to quickly and easily unlock the lid of the trunk.

SUMMARY OF THE INVENTION

In view of the problem inherent in the conventional art, the object of the present invention is to automatically unlock the lid of the trunk of a car under predetermined conditions without using a key. The invention is based upon the idea that the driver carry a portable signal generator with him and that an electric unlocking device be actuated upon receipt of a predetermined signal emitted by the signal generator.

According to the present invention, there is provided a device for unlocking a lid in a vehicle comprising: unlocking actuator means for unlocking the lid upon receipt of an electric signal; transmitter means with a power source for generating and transmitting a specific magnetic unlocking signal; magnetic sensor means for receiving the specific magnetic unlocking signal from the transmitter means; signal processing means for processing the output signal of the magnetic sensor means; and controller means which receives the output signal from the signal processing means and which generates a signal for controlling the unlocking actuator means; the magnetic unlocking signal being received by the magnetic sensor means, the unlocking actuator being controlled through the signal processing means and the controller means, and, hence, the lid being unlocked.

DESCRIPTION OF THE PREFERRED EMBODIMENTS

Figure 1:
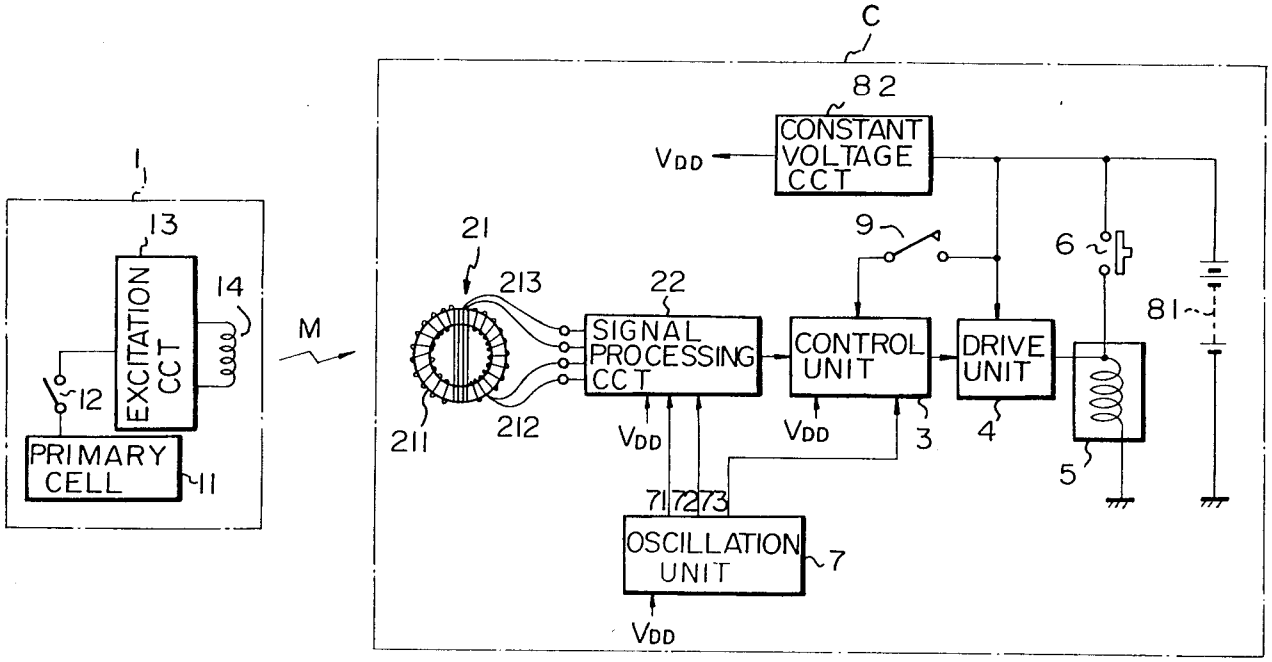
FIG. 1 is a diagram of a device for unlocking lid provided in a vehicle according to an embodiment of the present invention.

In FIG. 1 is shown a device for unlocking a lid provided in a vehicle according to an embodiment of the present invention, in which reference numeral 1 denotes a transmitter which a person will carry with him when he gets out of the car, C denotes a unit mounted on the vehicle, and 21 denotes a magnetic sensor which receives magnetic signals emitted from the transmitter. The magnetic sensor 21 is mounted on an outer portion of the vehicle. Reference numeral 22 denotes a signal processing circuit, 3 denotes a control unit which receives signals produced by the signal processing circuit and which generates signals that will be supplied to a drive unit 4 which generates signals for energizing a trunk solenoid coil, and 5 denotes a trunk-opening solenoid coil that works as an actuator. Reference numeral 81 denotes a storage battery mounted on the vehicle, and 82 denotes a constant-voltage circuit which stabilizes the voltage of the storage battery 81 to supply power to the signal processing circuit 22, to the control unit, and to the oscillation unit 7 that produces fundamental oscillation signals and signals obtained by dividing the frequency of fundamental oscillation signals. These signals are input to the signal processing circuit 22 and to the control unit 3. Reference numeral 9 denotes an ignition switch and 6 denotes a trunk-opening switch which is capable of actuating the solenoid 5 at any time irrespective of the signals produced by the control unit 3.

Figure 2:
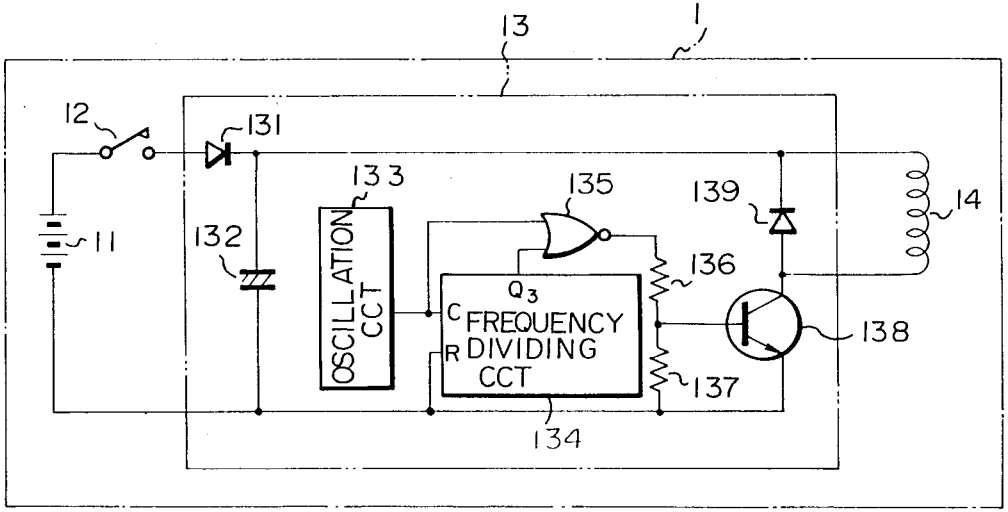
FIG. 2 is a diagram of the setup of a transmitter employed in the device of FIG. 1.

In FIG. 2 is shown the construction of the transmitter. A coil 14 is excited by modulated signals produced by an oscillation circuit 133, a frequency-dividing circuit 134, and a NOR gate 135 of an excitation circuit 13, thereby to produce magnetic signals M. Reference numeral 11 denotes primary cell and 12 denotes a switch which controls the supply of electric power from the primary cell.

Figure 3:
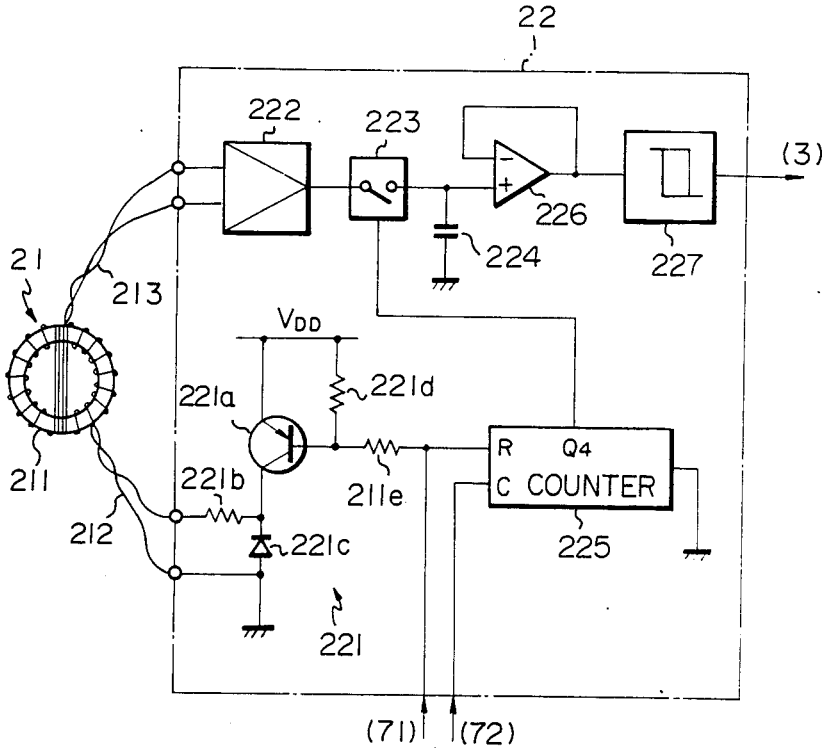
FIG. 3 is a diagram of the setup of a signal processing circuit in the device of FIG. 1.

In FIG. 3 is shown the construction of the signal processing circuit 22, in which reference numeral 221 denotes a drive signal generating unit which generates signals for driving the magnetic sensor 21. Here, provision is made of an amplifier circuit 222, a switching device 223, a capacitor 224, a decimal counter 225, a buffer 226, and a waveform shaping circuit 227. The switching device 223, capacitor 224, and decimal counter 225 constitute a sample-holding circuit. The sample-holding circuit, amplifier circuit 22, buffer 226, and waveform shaping circuit 227 constitute a detection circuit.

Figure 4:
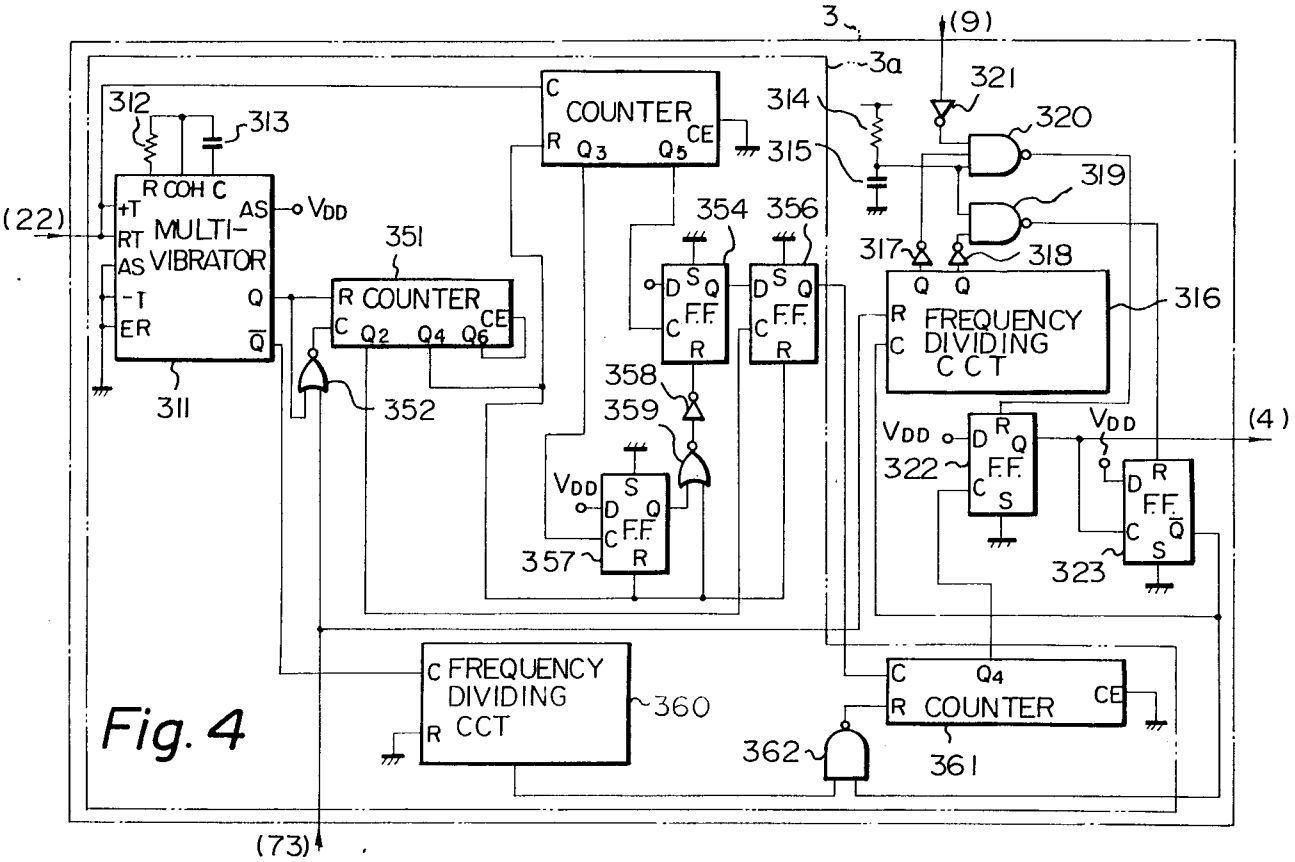
FIG. 4 is a diagram of the setup of a control unit in the device of FIG. 1.

In FIG. 4 is shown the construction of the control unit 3 which sends a pulse signal of a duration of about 0.5 second to the drive unit 4 via a decision circuit **3*a* which discriminates several times whether signals from the signal processing circuit 22** are regular signals or not.

In FIGS. 5A–5E and 6A–6H are shown signal waveforms at each of the portions of the circuits of FIGS. 2, 3, and 4.

Figures 5A, 5B, 5C, 5D, 5E:
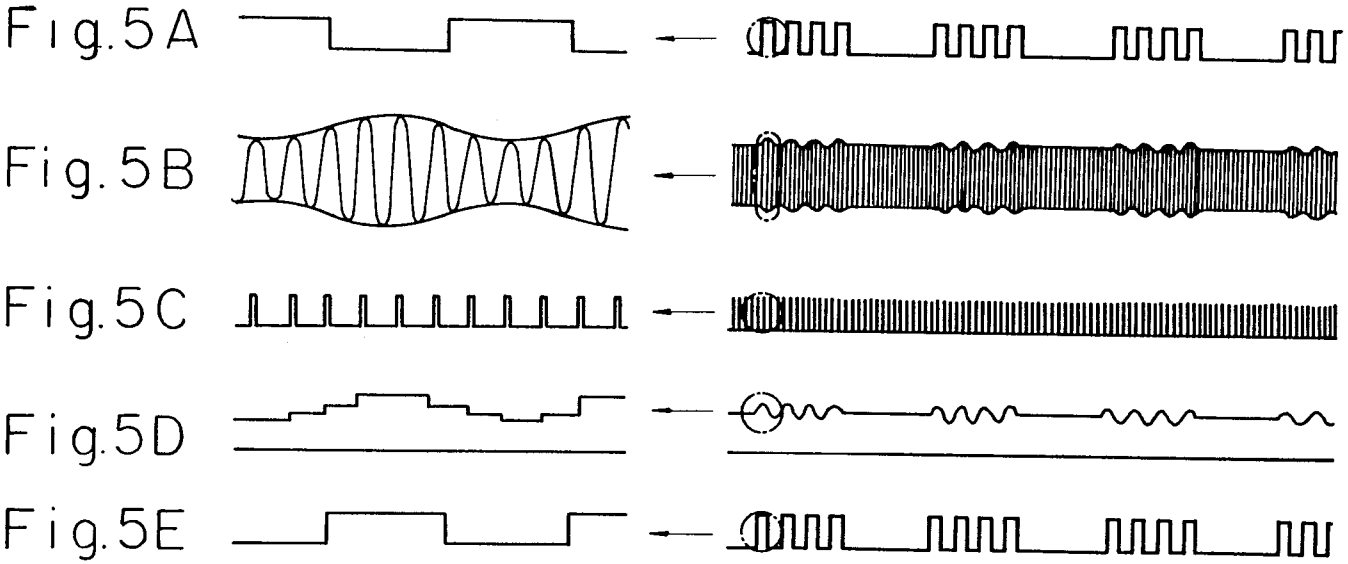
FIGS. 5A–5E and 6A–6H are diagrams of signal waveforms in the circuits of FIGS. 2, 3, and 4.

The operation of the device of FIG. 1 is described below. Signal wave forms at each of the portions are shown in FIGS. 5A–5E and 6A–6H. When the switch 12 is turned on, the oscillation circuit 133 performs a predetermined oscillation (for example 500 Hz). Output signals of the oscillation circuit 133 are input to the frequency-dividing circuit 134 (such as TC 4024 manufactured by Tokyo Shibaura Electric Co.), and are modulated by the frequency-divided outputs (such as $Q_3$) and by the NOR gate 135, thereby to form modulated signals as shown in FIG. 5A. The modulated signals shown in FIG. 5A excite the coil 14 via resistors 136, 137 and a transistor 138; i.e., the coil 14 undergoes magnetic change responsive to modulated signals shown in FIG. 5A.

A drive coil 212 wound on a ring-shaped magnetic core 211 of the magnetic sensor 21 is served, via drive unit 221, with frequency-divided signals (for example, 6.25 KHz) obtained by dividing the fundamental oscillation signals (for example, 1 MHz) produced by the oscillation unit 7 four times. Due to these signals, an intense magnetic field is established by the magnetic core 211. Under this condition, when magnetic change has developed responsive to modulated signals from the transmitter 1 which establishes an external magnetic field, signals (FIG. 5B) are produced on the detection coil 213 in proportion to the excited magnetic field on which is superposed the modulated magnetic field established by the transmitter 1. Therefore, the amplitude changes depending upon the intensity of the modulated magnetic field established by the transmitter 1.

The output signal of the detection coil 213 is amplified through an a-c amplifier in the signal processing circuit 22, and is input to the sample-holding circuit which holds the amplified output levels among the sample signals relying upon fundamental oscillation signals of the oscillation unit 7, frequency-divided signals (signals produced by the drive coil 212), and sample signals (FIG. 5C) produced by a decimal counter 225 (for example, TC 4017 manufactured by Tokyo Shibaura Electric Co.), and produces the output as shown in FIG. 5D on the output terminals of the sample-holding circuit. The outputs are shared by the waveform shaping circuit 27 to obtain output signals as shown in FIG. 5E.

The detection coil 213 and the signal processing circuit 22 will operate, for example, when the transmitter approaches a range within about 50 cm from the magnetic sensor 21. In order for the transmitter 1 to operate as mentioned above so that the lid can be unlocked, the switch 12 in the transmitter 1 must have been closed beforehand. Signals of FIG. 5E obtained through the signal processing circuit 22 are supplied to the control unit 3.

Figures 6A, 6B, 6C, 6D, 6E, 6F, 6G, 6H:
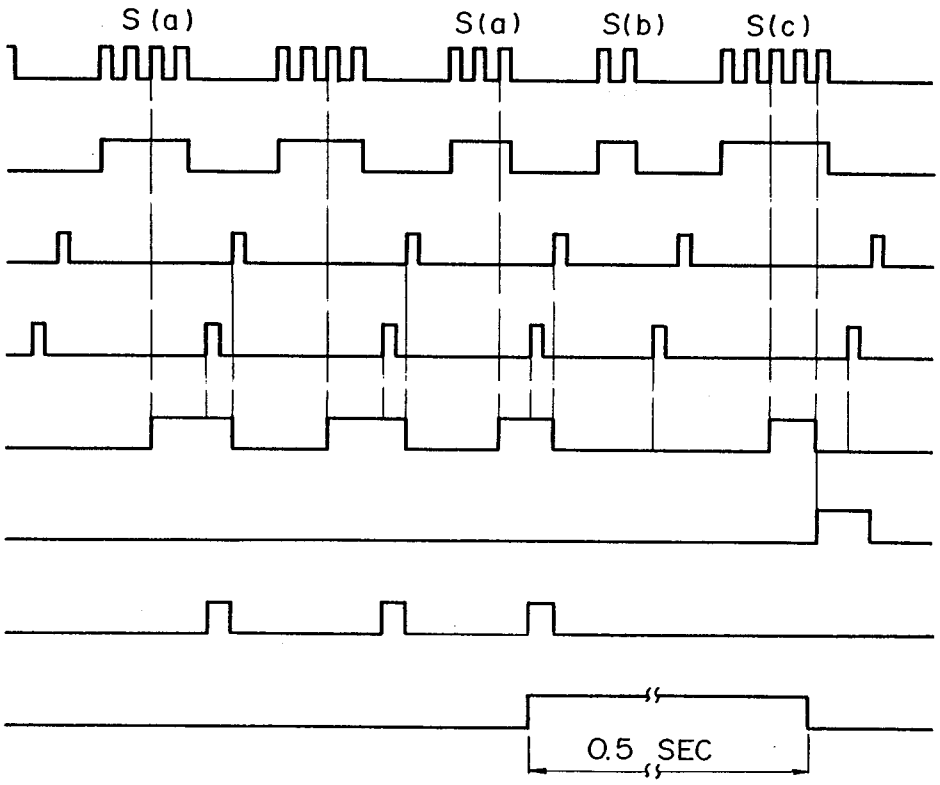

The operation of the control unit 3 is described below. Output signals (FIG. 6A) of the signal processing circuit 22 are counted with regard to their number of pulses between reset signals shown in FIG. 6C by a decimal counter 353 in the signal decision circuit 3*a*. Here, the reset signals of FIG. 6C and memory signals (FIG. 6D) that will be mentioned later, can be obtained from output signals (FIG. 6A) of the signal processing circuit and signals (for example, 1 KHz) obtained by dividing the frequency of fundamental oscillation signals of the oscillation unit 7, by using retriggerable multivibrator circuit 311 (such as TC 4047 manufactured by Tokyo Shibaura Electric Co.), a resistor 312, a capacitor 313, a decimal counter 351, and a NOR gate 352. In FIG. 6B is shown output signals produced by the multivibrator circuit 311. The decimal counter 353 in the signal decision circuit 3*a* counts the number of output pulses (FIG. 6A) produced by the signal processing circuit 22. Here, relying upon the circuit setup consisting of D-type flip-flops (such as TC 4013s manufactured by Tokyo Shibaura Electric Co.) 354, 357, NOR gate 359, and inverter gate 358, the decimal counter 353 causes the flip-flop 354 to produce the output Q (FIG. 6E) of the high level (condition of FIG. 6A, S(a)) when a regular signal consisting of more than 3 pulses but less than 5 pulses is received. When an abnormal signal (condition of FIG. 6A, S(b)) consisting of less than 3 pulses is received, the decimal counter 353 causes the flip-flop 354 to produce the output Q of the low level. Further, when an abnormal signal consisting of more than 5 pulses being caused by disturbance is received (condition of FIG. 6A, S(c)), the decimal counter 353 causes the D-type flip-flop 357 to produce the output (FIG. 6F) of the high level, and resets the flip-flop 354 so that it produces the output (FIG. 6E) of the low level. Output of the D-type flip-flop 354 is input to a flip--flop 356 and is stored by the memory signal (FIG. 6D). Whether regular signals (FIG. 6A) are received or not is discriminated between the reset signals (FIG. 6C) from the moment the pulses are counted by the decimal counter 353 to the moment the pulses are stored in the flip-flop 356.

In FIG. 6G is shown output signals produced by the flip-flop 356. Output signals (FIG. 6G) of the flip-flop 356 are counted by a decimal counter 361 several times, for example, four times. The decimal counter 361 then causes a flip-flop 322 to produce an output Q of the high level which is to be supplied to the drive circuit 4 of the trunk-opening solenoid coil 5, thereby to energize the solenoid coil and to unlock the trunk. At this moment, a flip-flop 323 produces an output $\overline{Q}$ of the low level. Output $\overline{Q}$ of the flip-flop 323 liberates the frequency-dividing circuit 316 (such as TC 4020 manufactured by Tokyo Shibaura Electric Co.) from the reset condition, and resets the content of the decimal counter 361 so that it ceases to produce the output. A frequency-dividing circuit 316 commences to count the time responsive to signals produced by the oscillation unit 7, and resets the flip-flop 322 after 0.5 second has passed, so that no current is permitted to flow into the solenoid 5 (FIG. 6H). Then, the flip-flop 323 is reset after 16 seconds have passed, and produces the output $\overline{Q}$ of the high level to return the decimal counter 361 to the initial state. Thus, the electric current flows into the solenoid 5 for 0.5 second; i.e., no current is then permitted to flow into the solenoid 5 for 16 seconds. Therefore, the luggage can be put into the trunk room during the period of 16 seconds. The switch 12 of the transmitter should then be opened. The decimal counter 361 introduces through its reset terminal the output $\overline{Q}$ of the retrigger circuit 311 via a frequency-dividing circuit 360 (such as 4024 manufactured by Tokyo Shibaura Electric Co.) and an NAND gate 362. This is to prevent the decimal counter 361 from counting abnormal signals that are generated in an isolated manner, so that a current-carrying signal is not sent to the drive circuit. That is, unless regular signals are continuously received four times while the frequency-dividing circuit 360 is producing the output (for example, output $Q_3$) of the high level, the decimal counter does not produce the output at the terminal $Q_4$. Therefore, the device is not erroneously operated by abnormal signals.

The signal from the ignition switch 9 is input to the reset terminal of the D-type flip-flop 322 via an inverter gate 321 and a three-input NAND gate 320. When the ignition switch is turned on, the flip-flop 322 is forcibly reset to produce an output Q of the low level, so that the lid of the trunk is locked when the car is running.

As a modification of the device of FIG. 1, the operations for several trunks for several automobiles are also possible by changing the modulation frequency.

The invention can be modified in a variety of other ways in addition to the above-mentioned embodiment. In the above embodiment, for instance, the transmission portion is modulated by the oscillation circuit and the output $Q_3$ of the frequency-dividing circuit. It is, however, allowable to use the output $Q_4$, output $Q_5$, ---, output $Q_n$ instead of the output $Q_3$. In this case, output signals of the signal processing circuit must be divided by $Q_{n-3}$ and input to the decimal counter in the control unit. By changing the modulation as mentioned above, operation of a plurality of units can be discriminated.

In the above-mentioned embodiment, furthermore, signals are transmitted and received being modulated by a frequency which is obtained by dividing the frequency of the oscillator. It is, however, also possible to use a coded oscillator (such as M 50110 manufactured by Mitsubishi Electric Co.) for transmitting the signals. When the coded oscillator is to be used, the decision circuit in the control unit can be realized by a decoder circuit (such as M 50111 produced by Mitsubishi Electric Co.) which produces a binary signal consisting of 4 bits, and a decoder circuit (such as TC 4515 produced by Tokyo Shibaura Electric Co.) which produces a binary signal consisting of 4 bits by rendering any one of 16 output terminals to assume the high level. Therefore, the output terminal of the decoder should be connected to the clock terminal of the D-type flip-flop.

In the above-mentioned embodiment, furthermore, although use is made of a solenoid coil as an unlocking actuator, it is also allowable to use an electric motor.

We claim:

1. A device for unlocking a lid provided in a vehicle comprising:

unlockng actuator means for unlocking the lid by using an electric signal;

means for generating a transmitted pulse signal having a plurality of groups of pulses;

means for modulating a predetermined frequency signal with said transmitted pulse signal to produce a specific magnetic unlocking signal;

means for transmitting said specific magnetic unlocking signal;

magnetic sensor means for receiving said specific magnetic unlocking signal from the transmitting means, said magnetic sensor means including a magnetic core, an exciting coil wound on the magnetic core and a detection coil wound on the magnetic core;

signal processing means, responsive to said sensor means, for generating a received pulse signal having a plurality of groups of pulses;

controller means for receiving said received pulse signal from said signal processing means and generating a controller pulse signal when the number of pulses in any said group of pulses is within a predetermined range; and counter means for counting pulses in said controller pulse signal and generating said electric signal only when said counter means has counted in sequence a predetermined number of consecutive pulses indicative of an equivalent number of consecutive valid groups of pulses in said received pulse signal.

2. A device as defined in claim 1, wherein said magnetic core is ring-shaped and said detection coil is wound across a diameter of said ring-shaped magnetic core.

3. A device as defined in claim 2, wherein said signal processing means comprises:

magnetic sensor exciting means for supplying an exciting signal of a constant frequency to said exciting coil of said magnetic sensor means; and detecting circuit means for amplifying, sample-and-holding, and pulse-shaping the output signal of said detection coil to generate said received pulse signal.

4. A device as defined in claim 1, wherein said generating means, modulating means and transmitting means are portable.

5. A device as defined in claim 1, further comprising means for prohibiting the generation of said electric signal when an ignition switch of said vehicle is closed.

6. A device as defined in claim 1, further comprising means for prohibiting the generation of the next electric signal for unlocking the lid during a predetermined length of time after the generation of said electric signal for unlocking the lid for enabling an operator to act near the lid after unlocking the lid without generating another electric signal during said predetermined length of time.

7. A device as defined in claim 1, wherein the lid provided in a vehicle is a lid of a trunk.

8. A device as defined in claim 7, wherein said transmitting means includes coil means, excited by said specific magnetic unlocking signal, for radiating magnetic power to said magnetic sensor means.

* * * * *